US008250895B2

(12) United States Patent
Bozkaya et al.

(10) Patent No.: US 8,250,895 B2
(45) Date of Patent: Aug. 28, 2012

(54) METHODS AND APPARATUS FOR CONTROLLING TEXTURE OF PLATES AND SHEETS BY TILT ROLLING

(75) Inventors: Dincer Bozkaya, Waltham, MA (US); Peter R. Jepson, Newbury, MA (US)

(73) Assignee: H.C. Starck Inc., Newton, MA (US)

( * ) Notice: Subject to any disclaimer, the term of this patent is extended or adjusted under 35 U.S.C. 154(b) by 754 days.

(21) Appl. No.: 12/221,759

(22) Filed: Aug. 6, 2008

(65) Prior Publication Data

US 2010/0031720 A1 Feb. 11, 2010

Related U.S. Application Data

(60) Provisional application No. 60/963,616, filed on Aug. 6, 2007.

(51) Int. Cl.
*B21B 39/20* (2006.01)

(52) U.S. Cl. ..... 72/250; 72/227; 72/231; 72/365.2; 72/700

(58) Field of Classification Search ..... 72/41, 43, 72/199, 229, 232, 236, 250, 251, 227, 231, 72/240, 365.2, 226, 234, 366.2, 700; 148/668
See application file for complete search history.

(56) References Cited

U.S. PATENT DOCUMENTS

| | | | | |
|---|---|---|---|---|
| 1,852,271 | A * | 4/1932 | Smith et al. | 29/17.4 |
| 2,123,291 | A * | 7/1938 | Smitmans | 72/202 |
| 2,250,541 | A * | 7/1941 | Lessmann | 72/12.4 |
| 3,811,305 | A * | 5/1974 | Saylor, Jr. | 72/39 |
| 4,086,105 | A * | 4/1978 | Mayrhofer et al. | 148/505 |
| 4,385,511 | A * | 5/1983 | Vydrin | 72/205 |
| 4,473,416 | A * | 9/1984 | Kawamo et al. | 148/111 |
| 5,850,755 | A * | 12/1998 | Segal | 72/261 |
| 5,992,201 | A * | 11/1999 | Ginzburg | 72/229 |
| 6,331,233 | B1 | 12/2001 | Turner | |
| 6,348,113 | B1 * | 2/2002 | Michaluk et al. | 148/668 |
| 6,348,139 | B1 | 2/2002 | Shah et al. | |
| 6,462,339 | B1 | 10/2002 | Michaluk et al. | |
| 6,519,994 | B1 * | 2/2003 | Quambusch | 72/237 |
| 6,521,173 | B2 | 2/2003 | Kumar et al. | |
| 6,740,421 | B1 * | 5/2004 | Goyal | 428/469 |
| 6,761,053 | B2 * | 7/2004 | Tazoe | 72/184 |
| 6,766,934 | B2 * | 7/2004 | Ziegelaar et al. | 226/21 |

(Continued)

FOREIGN PATENT DOCUMENTS

EP 1 265 717 B1 6/2001

(Continued)

OTHER PUBLICATIONS

International Search Report and Written Opinion of Corresponding PCT, Application No. PCT/US2008/009446, dated Aug. 6, 2008, published as WO 2009/020619 on Feb. 12, 2009.

(Continued)

*Primary Examiner* — Edward Tolan
(74) *Attorney, Agent, or Firm* — Dobrusin & Thennisch P.C.

(57) ABSTRACT

Methods and apparatus for rolling metal sheet or plate are provided. The method comprises the step of feeding the metal plate or sheet into a rolling mill at an angle. The apparatus comprises a rolling mill having a tilted feed table, or an apron upon which a transfer table and tilted feed table can rest. Through-thickness gradient and shear texture can be improved using the methods and apparatus of the invention.

35 Claims, 6 Drawing Sheets

U.S. PATENT DOCUMENTS

| | | | | |
|---|---|---|---|---|
| 6,770,154 | B2 | 8/2004 | Koenigsmann et al. | |
| 6,893,513 | B2 | 5/2005 | Michaluk et al. | |
| 6,908,517 | B2 * | 6/2005 | Segal et al. | 148/559 |
| 6,976,380 | B1 | 12/2005 | Hartwig, Jr. et al. | |
| 7,067,197 | B2 | 6/2006 | Michaluk et al. | |
| 7,081,148 | B2 | 7/2006 | Koenigsmann et al. | |
| 7,228,722 | B2 * | 6/2007 | Spreckelsen et al. | 72/377 |
| 7,341,096 | B2 * | 3/2008 | Van Der Winden | 164/476 |
| 7,485,198 | B2 | 2/2009 | Michaluk | |
| 7,998,287 | B2 | 8/2011 | Wickersham et al. | |
| 2002/0112789 | A1 | 8/2002 | Jepson et al. | |
| 2005/0247386 | A1 | 11/2005 | Matera et al. | |
| 2006/0201589 | A1 | 9/2006 | Morales et al. | |
| 2007/0144623 | A1 | 6/2007 | Wickersham | |

FOREIGN PATENT DOCUMENTS

| | | | |
|---|---|---|---|
| JP | 55165217 | | 12/1980 |
| JP | 03032404 | | 2/1991 |
| SU | 931244 | | 5/1982 |
| WO | WO 99/02743 | | 1/1999 |
| WO | WO 03/018221 | A2 | 3/2003 |
| WO | WO 2004/111295 | A1 | 12/2004 |
| WO | WO 2006/026621 | A2 | 3/2006 |
| WO | WO 2006/026621 | A3 | 3/2006 |

OTHER PUBLICATIONS

International Preliminary Report of Corresponding PCT, Application No. PCT/US2008/009446, dated Aug. 6, 2008, published as WO 2009/020619 on Feb. 12, 2009.

U.S. Appl. No. 12/221,646, filed Aug. 5, 2008, Jepson, et al.

Zhang, F., et al., Experimental and simulation textures in an asymmetrically rolled zinc alloy sheet, Scripta Materialia 50 (2004) 1011-1015.

Jin, H., et al., Reduction of planar anisotropy by texture modification through asymmetric rolling and annealing in AA5754, Materials Science & Engineering A 399 (2005) 358-67.

Jin, H., et al. Evolution of texture in AA6111 aluminum alloy after asymmetric rolling with various velocity ratios between top and bottom rolls, Materials Science & Engineer A 465 (2007) 267-273.

Kim, S-H., et al., Texture and microstructure changes in asymmetrically hot rolled AZ31 magnesium alloy sheets, Materials Letters 59 (2005) 3876-3880.

Lee, J-K, et al., Texture control and grain refinement of AA1050 A1 alloy sheets by asymmetric rolling, International Journal of Mechanical Sciences 50 (2008) 869-887.

Sha, Y, et al, Improvement of recrystallization texture and magnetic property in non-oriented silicon steel by asymmetric rolling, J. of Magnetic Materials 320 (2008) 393-96.

Kim, J-K, et al, Formation of textures and microstructures in asymmetrically cold rolled and subsequently annealed aluminum alloy 1100 sheets, J. of Materials Science 39 (2004) 5365-5369.

Lee, S., et al, Analysis of deformation textures of asymmetrically rolled steel sheets, International Journal of Mechanical Sciences 43 (2001) 1997-2015.

Lee, D., Strain energy release maximization model for evolution of recrystallization textures, International Journal of Mechanical Sciences 42 (2000) 1645-1678.

Park, Y.B., et al, The evolution of recrystallization textures in body centred cubic metals, Acta Mater., vol. 46, No. 10 (1998) 3371-3379.

Zhang et al., Effect of Grain Orientation on Tantalum Magnetron Sputtering Yield, J. Vac. Sci. Technol. A 24(4), Jul./Aug. 2006.

Wickersham et al., Measurement of Angular Emission Trajectories for Magnetron-Sputtred Tantalum, J. Electronic Mat., vol. 34, No. 12, 2005.

Shivpuri et al., Finite element investigation of curling in non-symmetric rolling of flat stock, Int. J. of Mech. Sci., vol. 30, 1988.

Knight et al., Investigations into the influence of asymmetric factors and rolling parameters on strip curvature during hot rolling, J. Mat. Proc. Tech., vol. 134, 2003.

Field et al., Microstructural Development in Asymmetric Processing of Tantalum Plate, J. Electronic Mat., vol. 34, No. 12, 2005.

Morra, M.M. et al., Uniformity of Properties in Alloy 706 Through Control of Forging, The Minerals, Metals & Materials Society, 1997, 279-290.

Michaluk, Christopher A. et al., Quantifying the Recrystallization Texture of Tantalum, JOM, Mar. 2002, 51-54.

International Search Report and Written Opinion of commonly owned PCT Application No. PCT/ US2008/009388, dated Aug. 5, 2008, published as WO 2009/020587 on Feb. 12, 2009.

International Preliminary Report of Patentability of commonly owned PCT Application No. PCT/US2008/009388, dated Aug. 5, 2008, published as WO 2009/020587 on Feb. 12, 2009.

Office Action mailed on Nov. 30, 2011 from the US Patent Office for U.S. Appl. No. 12/221,646.

Office Action mailed on Aug. 8, 2011 from the US Patent Office for U.S. Appl. No. 12/221,646.

J.B. Clark et al., "Influence of Initial Ingot Breakdown on the Microstructural and Textural Development of High-Purity Tantulum," Metallurgical and Materials Transactions A, 22 (12), 2959-2968 (1992).

J.B. Clark et al., "Influence of Transverse Rolling on the Microstructural and Texture Development in Pure Tantalum," Metallurgical Transactions A, 23A 2183-2191 (1992).

J.B. Clark et al., "Effect of Processing Variables on Texture and Texture Gradients in Tantalum," Metallurgical Transactions A, 22A, 2039-2048 (1991).

H. Jin et al., "Development of Grain Structure and Texture During Annealing in Asymmetrically Rolled AA5754," Materials Science Forum, vols. 467-470, 381-386 (2004).

J.W. Pugh et al., "Rolling Textures in Tantalum," Trans. ASM, 48, 526-539 (1956).

C. Pokross, "Controlling the Texture of Tantalum Plate," JOM Journal of the Minerals, Metals and Materials Society, 41:10, 46-49 (1989).

S. N. Mathaudhu et al., "Processing Microstructure Property Relationships in Severely Deformed Tantalum," Materials Science and Engineering A, 463 94-100 (2007).

* cited by examiner

METHODS AND APPARATUS FOR CONTROLLING TEXTURE OF PLATES AND SHEETS BY TILT ROLLING

CROSS-REFERENCE TO RELATED APPLICATION

This application claims priority under 35 U.S.C. §119(e) to provisional application Ser. No. 60/963,616, filed Aug. 6, 2007, incorporated by reference herein in its entirety.

FIELD OF THE INVENTION

The present invention relates to a manufacturing method and apparatus for producing plates and sheets with shear texture or minimal through-thickness texture gradient, or both.

BACKGROUND OF THE INVENTION

The crystallographic texture of a plate or sheet plays an important role in many applications. Crystallographic texture is crucial for the performance of the sputtering targets used to deposit thin films, due to the dependence of the sputtering rate on crystallographic texture.

The uniformity of thin films deposited from a sputtering target with non-uniform crystallographic texture is not satisfactory. Only a plate with uniform texture throughout its volume will give optimum performance.

The rate of sputtering from a grain in the target depends on the orientation of the crystal planes of that grain relative to the surface (ref. Zhang et al, *Effect of Grain Orientation on Tantalum Magnetron Sputtering Yield*, J. Vac. Sci. Technol. A 24(4), July/August 2006); the sputtering rate of each orientation relative to the plate normal is different. Also, certain crystallographic directions are preferred directions of flight of the sputtered atoms (ref. Wickersham et al, *Measurement of Angular Emission Trajectories for Magnetron-Sputtered Tantalum*, J. Electronic Mat., Vol 34, No 12, 2005). The grains of a sputtering target are so small (typically 50-100μm diameter) that the orientation of any individual grain has no significant effect. However, over a larger area (an area roughly 5 cm to 10 cm diameter) texture can have a significant effect. Thus, if the texture of one area on the surface of a target is different from the texture of any other area, the thickness of the film produced is unlikely to be uniform over the whole substrate. Also, if the texture of a surface area is different from that of the same area at some depth into the target plate, the thickness of the film produced on a later substrate (after the target is used, or eroded, to that depth) is likely to be different from that produced on the first substrate.

So long as the texture of one area, then, is similar to that of any other, it is not important what that texture is. In other words, a target plate in which every grain has a 111 orientation parallel to the plate normal direction (ND) is no better and no worse than one in which every grain has a 100 orientation parallel to ND, or than one which consists of a mix of 100, 111 and other grains, so long as the proportions of the mix remain constant from area to area.

Uniformity of film thickness is of major importance. In integrated circuits, several hundred of which are created simultaneously on a silicon wafer, for example, too thin a film at one point will not provide an adequate diffusion barrier, and too thick a film at another point will block a via or trench, or, if in an area from which it should be removed in a later step, will not be removable. If the thickness of the film deposited is not within the range specified by the designer, the device will not be fit for service, and the total cost of manufacture up to the point of test is lost, since no repair or rework is normally possible.

If the target does not have uniform texture, and thus does not provide a predictable, uniform sputtering rate, it is impossible, with state-of-the-art sputtering equipment, to control the variation of thickness from one point on the substrate to another. Partial, but not total, control of variation of thickness from substrate to substrate, and from target to target, is possible using test-pieces. Use of test-pieces, however, is time-consuming and costly.

With targets made according to the prior art, the non-uniformity of texture found in the target plate causes unpredictability or variability in the sputtering rate (defined as the average number of tantalum atoms sputtered off the target per impinging argon ion), leading to variations in the thickness of the film produced on a particular substrate, and also variations in film thickness from substrate to substrate and target to target.

Crystallographic texture also affects the mechanical behavior of a material. This is due to differences in the mechanical behavior of a single crystal of an anisotropic material when tested in different directions. Although single crystal materials are used in various applications, the majority of materials used in practice are polycrystals, which consist of many grains. If the grains forming a polycrystal have a preferred orientation (i.e. crystallographic texture), the material tends to behave like a single crystal having similar orientation. The formability of a material depends on the mechanical behavior of the material, which is a strong function of crystallographic texture.

Other material properties such as magnetic permeability are also influenced by crystallographic texture. For example, crystallographic texture is an important factor for the performance of a grain-oriented silicon steel, which is mainly used as the iron core for transformers and other electric machines. Improved magnetic properties, such as high magnetic permeability of the grain-oriented silicon steels, result in energy savings. To achieve good magnetic properties, a grain-oriented silicon steel should have strong <110>//ND and <100>//RD (rolling direction) texture (Goss orientation), which can then be easily magnetized in the rolling direction.

Crystallographic texture develops as a material is plastically deformed, and plastic deformation can only occur along certain slip systems that become active during deformation. Normal and shear strain components, along with other parameters such as temperature, determine which slip systems become active. Activation of a slip system causes grains to rotate towards a certain orientation, resulting in a crystallographic texture. The final crystallographic texture of a material is a strong function of both the starting texture and the strain induced in the material.

For example, during rolling of a plate in plane strain condition, material through the thickness of the plate is subjected to shear and normal strains simultaneously. The amount of shear strain varies significantly through the thickness of a plate. The mid-thickness of a plate is not subjected to any shear strain due to the symmetry of a conventional rolling process, whereas locations away from mid-thickness experience both shear and normal strains. Therefore, texture at the mid-thickness of a plate is considerably different than other locations.

Non-uniformity of texture through the thickness of a plate is referred to as the "through-thickness texture gradient". Conventional rolling produces a plate or sheet with a strong through-thickness texture gradient. Neither the through-thickness texture gradient nor the main components of texture can be altered significantly by parameters which are varied and controlled in conventional rolling, such as % reduction in thickness per pass and rotation between passes.

Certain texture components, i.e. "rolling texture" components, become dominant in conventional rolling. Rolling texture components for a bcc metal are different than "shear texture" components, which form when a bcc metal is subjected to shear strain. When subjected to shear strain, the grains in a bcc metal rotate towards <110>//ND. An almost opposite behavior is observed for a fcc metal, which, when subjected to shear strain, will cause <111>//ND and <100>//ND to become the major texture components. The greater the shear strain introduced in a workpiece, the stronger the shear texture developed.

In a material (fcc or bcc) with a perfectly random texture, 10.2% of the volume (and 10.2% by number of the grains) has a <100> axis within 15-deg of ND. Another 13.6% of the volume has a <111> axis within 15-deg of ND and a further 20.4% of the volume has a <110> axis within 15-deg of ND. Therefore, a fcc material is said to have a shear texture if more than 10.2% of the volume has a <100> axis within 15-deg of ND, and more than 13.8% of the volume has a <111> axis within 15-deg of ND. A bcc material is said to have shear texture if more than 20.4% of the volume has a <110> axis within 15-deg of ND.

A higher plastic strain ratio (r-value) is known to enhance formability of a metal, and a bcc or fcc metal with a dominant <111>//ND texture component has higher plastic strain ratio (r-value). Therefore, shear texture with <111>//ND as one of the major components is desirable for improving the formability of a fcc metal.

The amount of shear strain through the thickness of a plate or sheet can be altered by switching from a conventional (symmetric) rolling to an asymmetric rolling process. The total amount of shear strain through the thickness can be increased, and more specifically, the mid-thickness can be subjected to some amount of shear strain, which is not possible in conventional rolling. Prior art asymmetric rolling methods include use of rolls with different diameters, rolls with different rotational speeds, and rolls with different surface properties that result in different friction coefficient between the top surface of a workpiece and the top roll, and the bottom surface of a workpiece and the bottom roll. Due to the difficulties in controlling the friction coefficient consistently, asymmetric rolling with different friction coefficients top and bottom is impractical and is excluded from further discussion here. These prior art methods can also be used to decrease the through-thickness texture gradient.

The application of the above-mentioned types of asymmetric rolling for introducing shear texture and minimizing texture gradient have been described in the prior art. See, e.g., Field et al., *Microstructural Development in Asymmetric Processing of Tantalum Plate*, J. Electronic Mat., Vol 34, No 12, 2005; Sha et al., *Improvement of recrystallization texture and magnetic property in non-oriented silicon steel by asymmetric rolling*, J. Magnetism and Magnetic Mat., Vol 320, 2008; Lee and Lee, *Analysis of deformation textures of asymmetrically rolled steel sheets*, Internat. J. Mech. Sci., Vol 43, 2001; Lee and Lee, *Texture control and grain refinement of AA*1050 *Al alloy sheets by asymmetric rolling*, Internat. J. Mech. Sci., Vol 50, 2008; Jin et al. *Evolution of texture in AA*6111 *Al alloy after asymmetric rolling with various velocity ratios between top and bottom rolls*, Mat. Sci. and Eng., Vol 465, 2007; Jin et al. *The reduction of planar anisotropy by texture modification through asymmetric rolling and annealing in AA*5754, Mat. Sci. and Eng., Vol 399, 2005; Kim et al. *Formation of textures and microstructures in asymmetrically cold rolled and subsequently annealed aluminum alloy* 1100 *sheets*, J. Mat. Sci., 2003; Zhang et al. *Experimental and simulation textures in an as symmetrically rolled zinc alloy sheet*, Scripta Materialia, Vol 50, 2004; and Kim et al. *Texture and microstructure changes in asymmetrically hot rolled AZ*31 *magnesium alloy sheets*, Mat. Lett. 59, 2005.

The asymmetric rolling methods described above introduce some amount of shear strain through the thickness of the plate by using asymmetry in the top and bottom roll diameter or the top and bottom roll speed. As the roll diameter or roll speed ratios of the top and bottom rolls increase, the shear strain introduced in the plate increases, but there are practical limits to these ratios and the amount of shear strain that can be introduced with these methods.

SUMMARY OF THE INVENTION

Accordingly, the present invention provides an apparatus and a rolling method for controlling the crystallographic texture of a material to improve the related material properties and enhance the performance of the material. The present invention allows the introduction of a controlled amount of shear strain through the thickness of a plate or a sheet, which results in plates and sheets with minimal through-thickness texture gradient. A minimal through-thickness texture gradient in sputtering targets improves the predictability and uniformity of the thickness of the films produced, and thus improves the ease of use of the targets.

The introduction of shear strain can also provide shear texture that results in better formability of materials, such as fcc metals, which increases the yield and decreases processing costs for forming operations used widely in many industries.

The improved shear texture also improves the magnetic properties (i.e. magnetic permeability) of the materials such as grain oriented silicon steel. Improved magnetic properties result in energy savings as grain oriented silicon steel is used as iron core for transformers and other electric machines.

In the present invention, the workpiece (a plate or sheet) is tilted about an axis parallel to the axis of the rolls in a rolling mill with a prescribed angle (tilt angle). The tilted workpiece is fed into the rolls and the entry tilt angle is maintained during the entire rolling pass. As used herein, this process is referred to as "tilt rolling". The material through the thickness of the workpiece is sheared as a result of tilt rolling. The amount of shear strain can be controlled by the tilt angle along with other rolling parameters that are normally controlled in conventional rolling. Multiple passes are used to reduce the thickness of the workpiece to the desired value.

Tilt rolling can be achieved by a specially designed rolling mill with aprons that can be tilted to different angles. In an embodiment, the tilted apron is an integral part of the rolling mill. This permits utilization of a rolling mill for both conventional and tilt rolling with very quick change-over. In another embodiment, tilt rolling can also be implemented in a conventional rolling mill by means of a fixture that can be easily installed on the mill without major modifications. In this embodiment, the initial investment for equipment is smaller, and the rolling mill can be used for both conventional and tilt rolling, but the change-over time is greater than the specially designed rolling mill described above. However, in both embodiments, a relatively small change-over time between conventional and tilt rolling provides production flexibility unlike the alternative asymmetric rolling processes that require increased time for change over, resulting in greater down-times for the equipment.

Accordingly, in one aspect the present invention provides a method of rolling a metal plate or sheet, the method comprising the step of feeding the plate or sheet into rollers in a rolling mill at an angle of between 2-20 degrees above or below horizontal.

In an additional aspect, the present invention provides an apparatus for rolling a metal plate or sheet at an angle, the apparatus comprising a rolling mill having a tilted feed table inclined at an angle of between 2 and 20 degrees above or below horizontal.

These and other aspects of the invention will become more readily apparent from the following figures, detailed description and appended claims.

BRIEF DESCRIPTION OF THE DRAWINGS

The invention is further illustrated by the following drawings in which.

DETAILED DESCRIPTION OF THE INVENTION

As used herein in the specification and claims, including as used in the examples and unless otherwise expressly specified, all numbers may be read as if prefaced by the word "about", even if the term does not expressly appear. Also, any numerical range recited herein is intended to include all subranges subsumed therein.

A—Tilt-roll Process

Figure 1A:
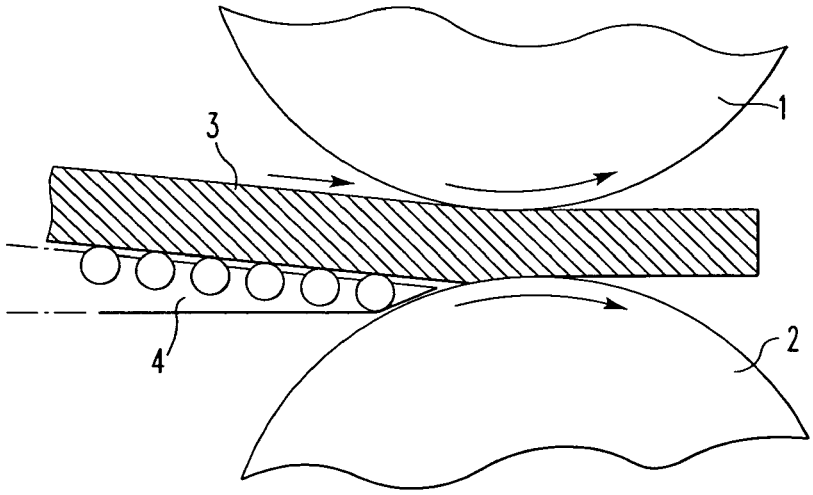
FIG. 1 is a diagram illustrating embodiments of tilt rolling a plate a) in a single stand mill and b) in multi-stand mill.
Figure 1B:
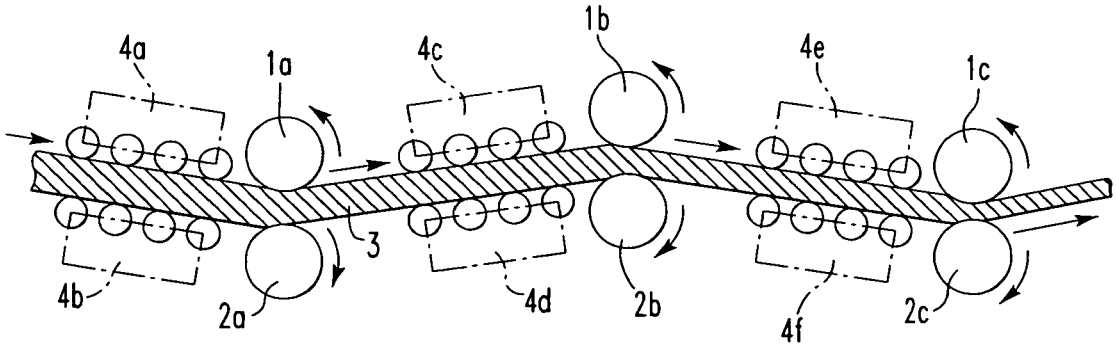

The tilt-rolling process of the present invention, as shown in two embodiments in FIG. 1, FIG. 1*a* for single stand and FIG. 1*b* for multi-stand mills, provides an improved method of introducing shear strain in a workpiece. In the tilt rolling process, a workpiece (3) is fed into the rolls (1) and (2) of a rolling mill with an entry tilt angle, using a tilted feed table (4*a-f*) or tilted apron. The entry tilt angle is maintained during the whole rolling process as the tilted feed table or tilted apron prevents the trailing edge of the workpiece from becoming horizontal.

The amount of shear strain introduced through the thickness of a material by tilt-rolling can be controlled by adjusting the parameters such as tilt-angle and % reduction in thickness after each pass, as explained below. The ability to control the amount of shear strain in a workpiece with the methods of the present invention permits achievement of two types of special texture in a plate or a sheet: 1) minimal through-thickness texture gradient, 2) shear texture throughout the thickness of the workpiece.

The angle selection depends on the primary objective of a user for using the tilt-rolling process; minimizing through-thickness texture gradient or inducing shear texture. Preferably, the angle of tilt above or below horizontal is between 2 and 20 degrees. To minimize the through-thickness gradient, the angle of tilt is preferably between 3 and 7 degrees. To increase the shear texture, preferably the angle of tilt is between 10 and 20 degrees.

As a general rule, shear texture can be more effectively introduced in a material as the tilt angle increases. However, the through-thickness texture gradient does not necessarily decrease with a larger tilt-angle. The % thickness reduction and tilt angle should be adjusted together for a given thickness of a workpiece to achieve minimal through-thickness texture gradient. The simulation methods for optimizing each important parameter are given in detail below, and one skilled in the art can adjust these parameters in additional simulations to balance the various effects and achieve the desired result, a final product in the form of a plate or a sheet with predominantly shear texture or minimal texture gradient.

The tilt angle may be above or below horizontal, depending on the pass. For rolling plate (single stand mill), the angle should be above horizontal because gravity is then used for locating the workpiece on the tilted-feed table. If a multi-stand mill is used for rolling sheet, the direction of the tilt angle is preferably alternated to save space in vertical direction and to distribute the effect of tilt rolling evenly to top and bottom halves of the sheet.

The strain in a workpiece has a direct influence on the "deformation texture", a well-known term in the art. After a material is strained using metal working methods (rolling in this case), the workpiece is preferably annealed by increasing the temperature of the workpiece above the recrystallization temperature to achieve recrystallization, especially if the metal working process is performed cold (near or below room temperature) or warm (above room temperature and below recrystallization temperature). If the workpiece reaches a temperature above recrystallization temperature during metal working processing, dynamic recrystallization may occur and the annealing step after metal working may not be necessary. The texture of a workpiece may change during recrystallization and the resulting texture is known as "recrystallization texture". However, the recrystallization texture of a workpiece is a strong function of the deformation texture. Therefore, the benefits of the tilt rolling methods of the present invention can be realized for cold, warm or hot rolling.

A metal plate or sheet can be passed through the rolls at a tilt more than once, in other words, 2, 3, 4, 5 or more passes. The passes are repeated until the desired thickness of the workpiece is reached. If symmetric texture about the mid-thickness of a workpiece is desired, especially for minimizing the through-thickness texture gradient, the % thickness reduction should be adjusted so that the minimum number of passes to reach the final thickness is preferably at least four or greater. Another consideration for maximum % reduction is the load on the mill. The % thickness reduction should be kept lower than a % reduction that would result in an excessive load on the mill.

Finite element simulations were used to compare the shear strain levels developed in a workpiece rolled with the tilt rolling methods of the present invention and other asymmetric rolling methods. Finite element simulation permits calculation of the amount and direction of strains in a workpiece, which is very difficult to accomplish in experiments. Finite element simulations are used as a tool here to quantify the influence of tilt rolling as compared to other asymmetric rolling methods. A finite element software package, Deform 2-D available from Scientific Forming Technologies Corp., Columbus, Ohio, was used for all the simulations.

Figure 2A:
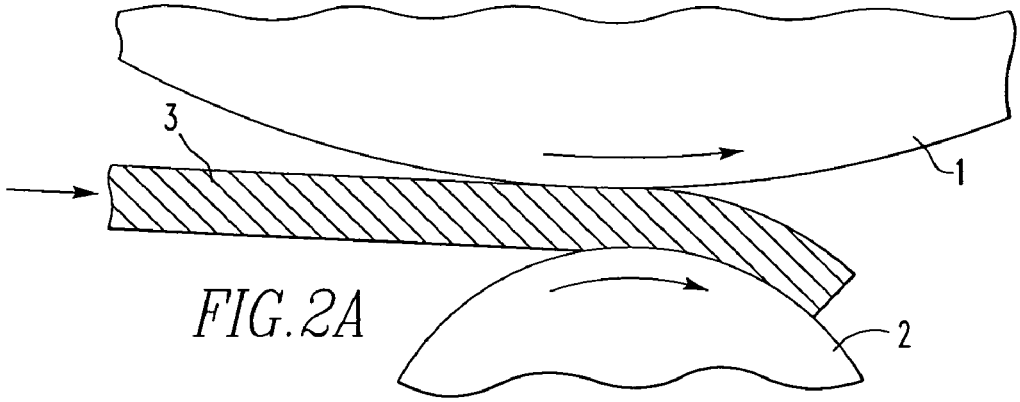
FIGS. 2(*a*), 2(*b*) and 2(*c*) are diagrams depicting finite element modeling of (a) asymmetric rolling with different roll diameters, (b) asymmetric rolling with different roll speeds and (c) tilt rolling.
Figure 2B:
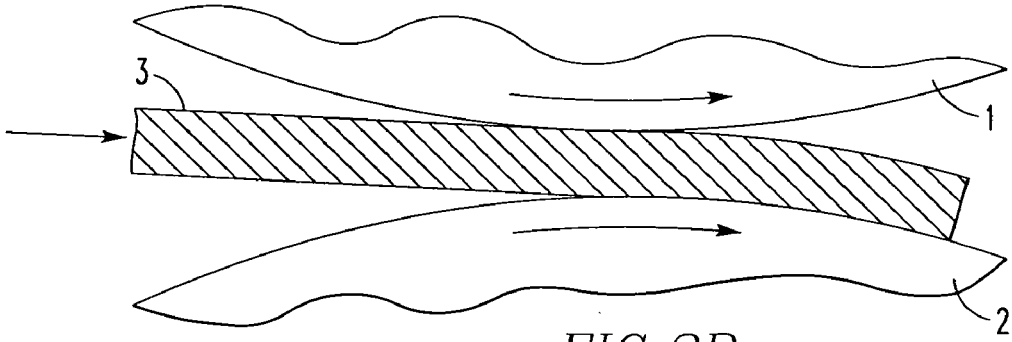
Figure 2C:
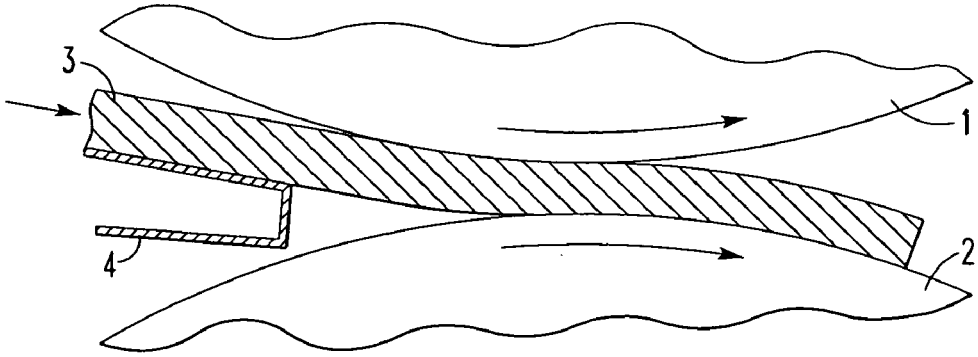

The simulations were set up for rolling a workpiece of an initial thickness of 0.5" in one pass. FIG. 2 shows the simulations set up for each process including the rolling with diameter ratio of 4 (FIG. 2*a*), speed ratio of 4 (FIG. 2*b*) and tilt rolling with tilt angle of 10-deg (FIG. 2*c*). In one set of simulations, the thickness of the workpiece was reduced by 5% per pass, and in another set 10% per pass. A friction coefficient of 0.5 and shear friction model was used in all simulations.

For the simulation of rolling with different roll speeds, the diameter of top and bottom rolls was set at 16". The rotational speed of the faster roll (1 in FIG. 2*b*) was taken to be 1 radian/s and the speed of the slower roll (2 in FIG. 2*b*) was varied based on the desired roll speed ratio. For the simulation of rolling with different roll sizes, the diameter of the larger roll (1) in FIG. 2*a* was fixed at 16" and the diameter of the smaller roll (2) in FIG. 2*a* was varied based on the desired roll diameter ratio. A rotational speed of 1 radian/second was used for rolling with different roll diameters.

The tilt rolling simulation used a roll diameter of 16" and a roll speed of 1 radian/second (approximately 10 rpm).

The friction coefficient, roll diameter and roll speed affect the simulation results quantitatively, but the conclusions drawn from the simulation results for the qualitative evaluation of different processes is not influenced significantly by the selection of these parameters.

FIG. 2 also shows the workpiece emerging curved from the rolls, an effect known as curling.

Tantalum, a bcc metal, was selected as the workpiece material. It is important to note that the amount of shear strain obtained in a material will be very similar in different materials for a given set of rolling parameters. However, the resulting texture due to the shear strain will vary based on the material. Therefore the simulation results for the shear strain are not influenced significantly by the material selected in the simulations.

Shear strain accumulates as a material goes through the rolls. The material is sheared in one direction at the entrance and the shear direction changes as the material passes the neutral point in rolling. The "cumulative" shear strain was calculated by the summation of the absolute values of the positive and negative shear components. The average cumulative shear strain through the thickness was calculated by averaging the shear strain of evenly spaced 5 locations from the top to the bottom surface of the workpiece.

Figure 3:
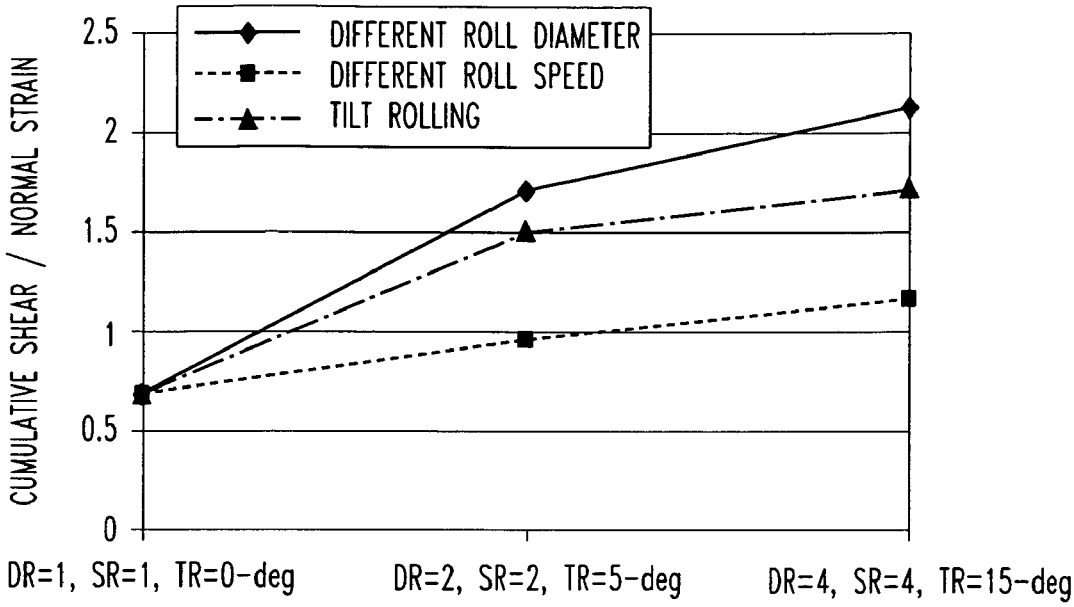
FIG. 3 is a graph showing the cumulative shear to normal strain ratio for a single pass (5% reduction of thickness) of asymmetric rolling with diameter ratio, 1<DR<4, speed ratio 1<SR<4 and tilt rolling with tilt angle, 0-deg<TR<15-deg.

FIG. 3 shows the cumulative shear to normal strain ratio for different processes in one pass with initial thickness of 0.5" and % reduction of 5. The diameter ratio (DR) and the roll speed ratio (SR) were varied in the range of 1-4. The tilt angle (TR) in the range of 0-15 deg. was simulated. A diameter (DR) and speed (SR) ratio of 1, and tilt angle (TR) of 0, are equivalent to conventional rolling. Linear interpolation was done to obtain the cumulative shear strain for values of tilt-angle, roll diameter and roll speed ratios not explicitly shown in FIG. 3.

FIG. 3 illustrates that tilt-rolling with a tilt angle (TR) of 5-deg achieves a shear strain similar to that achieved by using asymmetric rolling with a roll diameter ratio (DR) of 1.6.

Tilt-rolling with a tilt angle of 15-deg achieves a shear strain similar to that achieved by asymmetric rolling with roll diameter ratio of 2. FIG. 3 also shows that the shear strain achieved by tilt rolling with a tilt angle of 5-deg was greater than the shear strain achieved by asymmetric rolling with a roll speed ratio (SR) of 4.

The amount of shear strain introduced by any of the asymmetric rolling methods, including tilt rolling, depends on the thickness of the workpiece and the % reduction in thickness per pass. For example, if tilt-rolling is compared to other asymmetric rolling methods for the same thickness (0.5") and higher % reduction (for example 10%), slightly different results are obtained from the results presented in FIG. 3.

When the % thickness reduction is 10% per pass, the amount of shear strain averaged through the thickness for 5-deg tilt-rolling was equivalent to the amount of shear strain obtained by asymmetric rolling with diameter ratio of 1.65 and a speed ratio of 4. Tilt rolling with a 10-deg tilt angle, produced shear strain similar to diameter ratio of 2.

In light of these results, it can be concluded that the tilt-rolling process introduces shear strain in a material more effectively than other asymmetric rolling methods considering the limitations of each method. A tilt angle as low as 5 degrees causes equivalent or more shear strain when compared to asymmetric rolling with diameter ratio of 1.6 or asymmetric rolling with roll speed ratio of 4. Practical difficulties for implementing the process in a rolling mill may become severe for asymmetric rolling methods with roll diameter of 1.6 or speed ratios of 4, whereas no practical difficulty is encountered for tilt-rolling up to a tilt angle of 15 or 20 degrees.

Figure 4:
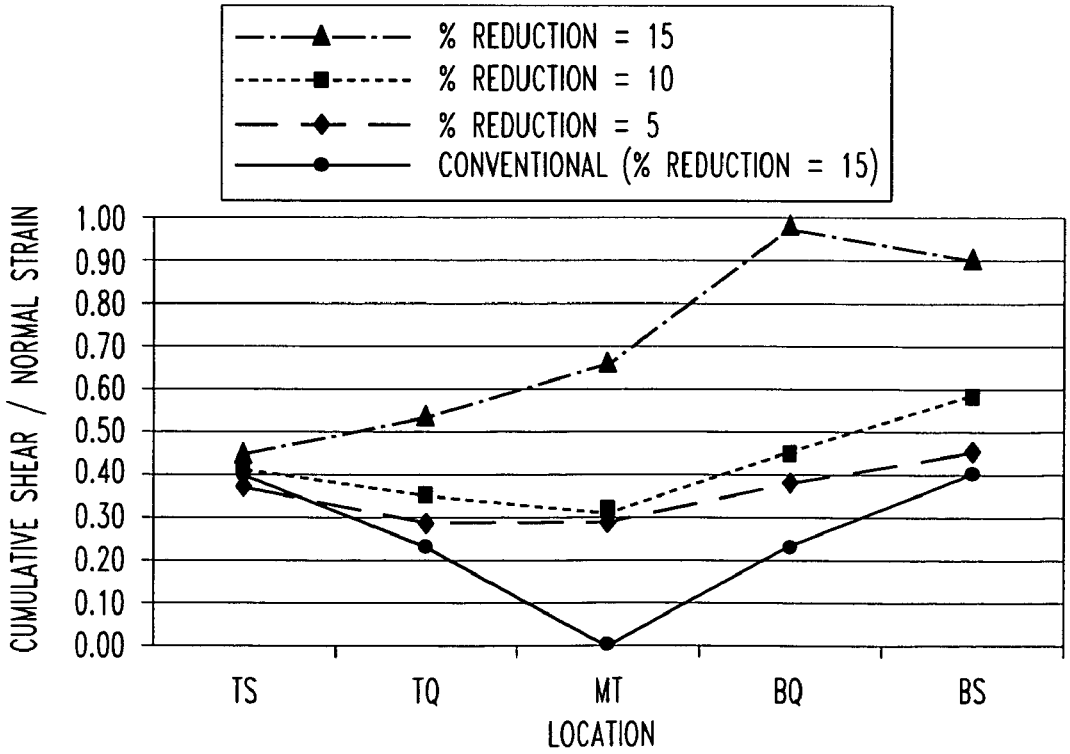
FIG. 4 is a graph showing the cumulative shear to normal strain ratio for single pass at different locations through the thickness of a workpiece. These locations are top surface (TS), mid-point between top surface and mid-thickness (TQ), mid-thickness (MT), mid-point between mid-thickness and bottom surface (BQ) and bottom surface (BS). The graph is plotted to illustrate the effect of different % reductions.

The shear strain through the thickness of a workpiece is neither uniform nor symmetric about the mid-thickness in one pass of tilt-rolling. FIG. 4 shows the finite element simulation results for the shear strain achieved at different locations through the thickness of the workpiece, top surface (TS), top quarter (TQ), mid-thickness (MT), bottom quarter (BQ) and bottom surface (BS) in tilt rolling with 5-deg tilt angle and % reduction per pass of 5-15%. FIG. 4 also illustrates the shear strain in conventional rolling for a 15% reduction per pass.

Figure 5:
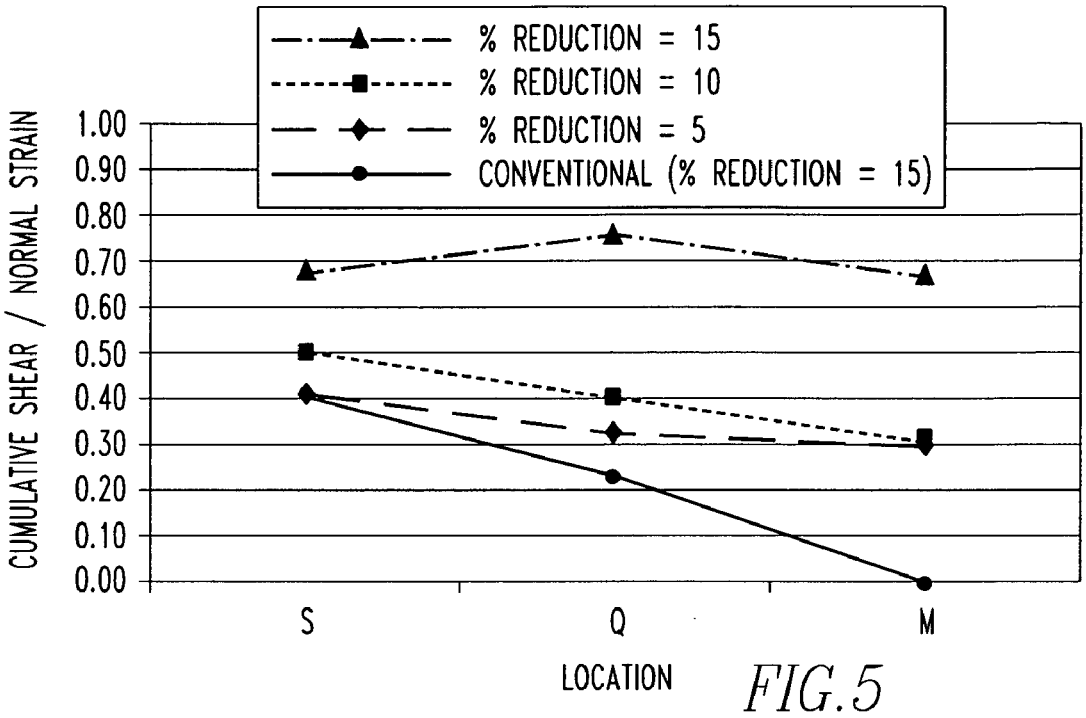
FIG. 5 is a graph showing the mean cumulative shear to normal strain ratio at surface (S), mid-point between surface and mid-thickness, Q and mid-thickness of plate (M). The values for S in FIG. 5 are obtained by averaging the values for TS and BS in FIG. 4, and values for Q in FIG. 5 are obtained by averaging the values for TQ and BQ in FIG. 4. The values for M in FIG. 5 are equivalent to the values for MT in FIG. 4.
Figure 6:
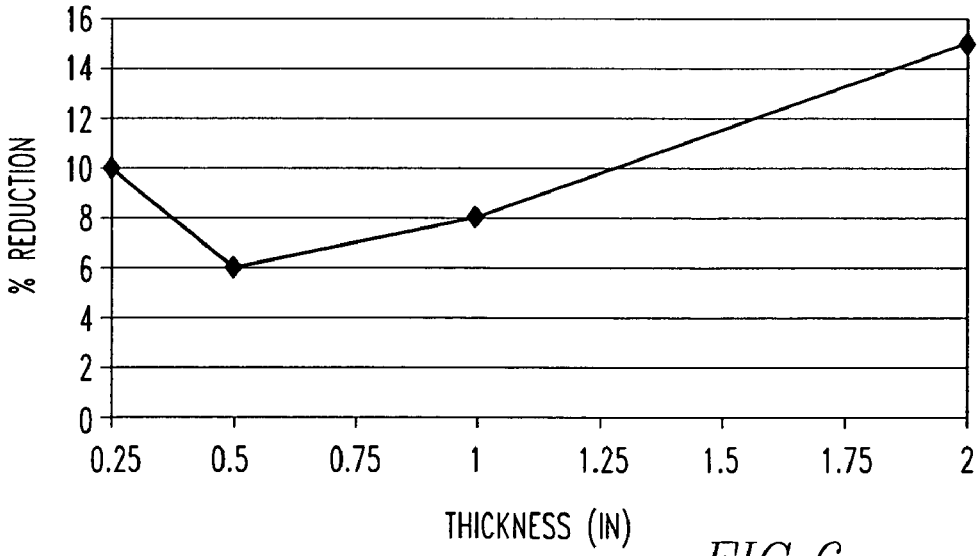
FIG. 6 is a diagram illustrating the optimum % reduction for minimizing the texture gradient in a workpiece rolled from 2" to 0.25" thickness.

In order to distribute the shear strain uniformly to the top and bottom halves of a workpiece, the workpiece may be turned over after each tilt-rolling pass or at regular intervals such as after every second pass. The frequency of turn-over of the workpiece is dependent on the requirements for the uniformity of the shear strain through the thickness of the workpiece. In order to minimize the through-thickness texture gradient, the variation of shear strain through the thickness should be decreased. The average shear strain for top and bottom surface (S), top and bottom quarter (Q), and mid-thickness (M) is plotted in FIG. 5. In the simulations, tilt-rolling clearly increased the shear strain at the mid-thickness (M) from zero for conventional rolling (TR=0-deg) to an amount slightly dependant on the % reduction but similar to that of surface (S) and quarter-thickness (Q). For a 0.5" thick workpiece, the through-thickness texture gradient can be minimized using a 6% reduction per pass and a 5-deg tilt angle. For a fixed tilt angle, an optimum % reduction per pass exists which will minimize the through-thickness texture gradient at different thicknesses of the workpiece. For 5-deg tilt angle, FIG. 6 shows the optimum % reduction for a workpiece with thickness between 0.25" and 2". The optimal % reduction can be determined for other angles using the simulations as described above.

Curling of a workpiece during conventional rolling can be a major problem in production if curling makes it difficult to feed the workpiece into the rolls or if the leading edge of the workpiece hits and damages the apron on the exit side of the mill. In addition to these practical difficulties, curling affects the normal strains in the workpiece and results in additional strain and texture non-uniformity. As a workpiece curls in rolling, additional strain due to curling is induced in the material. Strain due to curling reaches its maximum near the surface and decreases to zero at mid-thickness. The effect of curling on texture may be evaluated by comparing the maximum strain due to curling with the normal strain in rolling. Curling may also occur in tilt-rolling and other asymmetric rolling methods, unless minimized as follows.

It is known that curling of a workpiece may be minimized by optimizing the % reduction for a certain thickness in asymmetric rolling with different roll speeds. See, e.g., Shivpuri et al., '*Finite element investigation of curling in non-symmetric rolling of flat stock*', Int. J. of Mech. Sci., Vol. 30, 1988; and Knight et al., '*Investigations into the influence of asymmetric factors and rolling parameters on strip curvature during hot rolling*', J. Mat. Proc. Tech., Vol. 134, 2003.

Figure 7:
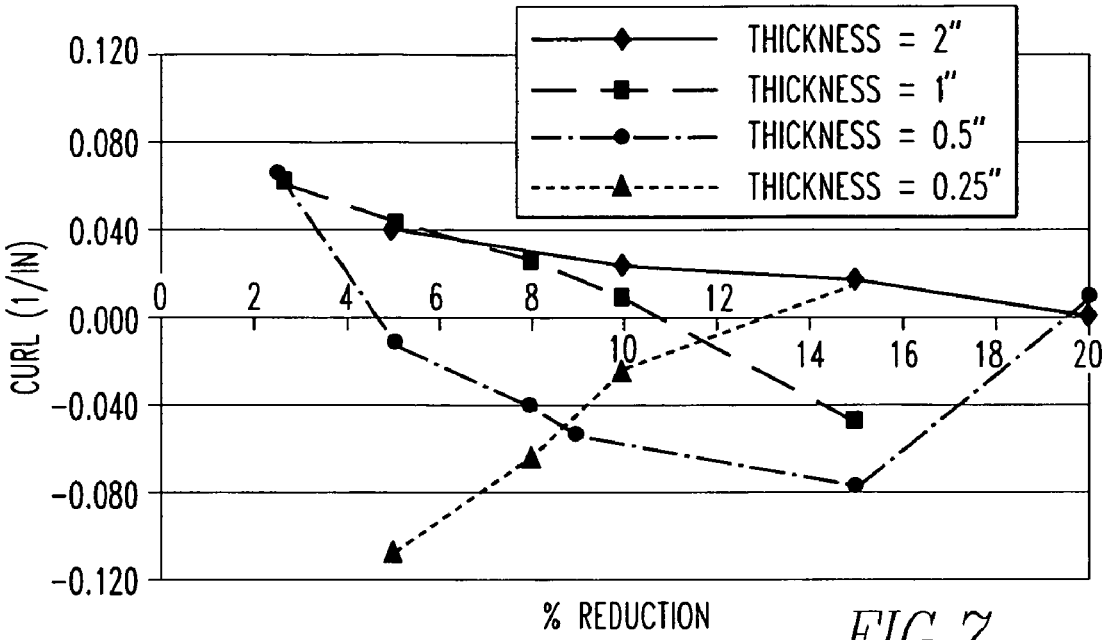
FIG. 7 is a graph showing the curling behavior of a workpiece quantified by the curl, which is the reciprocal of the radius of curvature of the workpiece after rolling. The effect of the % reduction in thickness on curling at different thicknesses of the workpiece is demonstrated.

The same concept can be applied to tilt-rolling. The simulation results presented in FIG. 7 (for a 5-deg tilt angle) show the curl of the workpiece as it exits the rolls for different thicknesses and % reduction. Note that the maximum % reduction in the simulations was 20%. The curl was quantified by calculating the reciprocal of the radius of curvature of the curled workpiece. The graph in FIG. 7 shows that there exists a % reduction where the curl is zero for each thickness and in some cases two such % reductions. FIG. 7 can be used as a guideline to optimize the rolling schedule for minimizing the curling of plates rolled with 5-deg tilt angle. Table 1 below lists the ranges of % reduction of a workpiece at different thickness rolled with 5-deg tilt angle for minimal curling. The column on the left gives the preferred % reductions so that the maximum strain near the surface of the workpiece due to curling is less than 20% of the normal strain. The column on the right shows the more preferred % reductions that can be used to maintain the maximum strain due to curling below 10% of normal strain due to rolling.

TABLE 1

| Thickness | % Reduction Range for 20% Curl Strain | % Reduction Range for 10% Curl Strain |
|---|---|---|
| 0.250" | 6.5-20 | 8-15 |
| 0.375" | 3-5 or 9-20 | 3.5-4.5 or 12.5-15 |
| 0.500" | 4-20 | 4.5-7 or 16-20 |
| 0.750" | 6-14 | 7-11 |
| 1.000" | 7.5-20 | 9-13.5 |
| 2.000" | 11-20 | 15.5-20 |

As used herein, the term "substantially no curling" refers to achieving a maximum curl strain that is 10% or less of normal strain. This can be achieved by using a predetermined % reduction, as explained above.

It is also necessary to control roll roughness and lubrication to ensure that the curling of a workpiece is consistent from pass to pass or from workpiece to workpiece. If the roll roughness and lubrication of top and bottom rolls are different, the friction coefficient between the top roll and workpiece, and the bottom roll and workpiece become different. This variation of the friction coefficient causes inconsistency in curling behavior and excessive curling may occur even when the % reduction is optimized for a given tilt angle and thickness of the workpiece. The rolls and the workpiece are preferably flooded with lubrication to increase the uniformity of the friction coefficient.

Another important factor in determining final texture is the starting texture of the workpiece. If the texture of the starting workpiece is not favorable, it will be difficult to achieve the benefits of tilt rolling by the methods of the invention. For example, if the texture of the starting workpiece before rolling is non-uniform, the texture after tilt rolling is likely to be non-uniform even though the strains induced in the tilt rolling are substantially uniform.

Depending on the requirements for the final product, a workpiece may be optionally tilt-rolled in some passes and conventionally rolled in other passes. The rolling practice used in conventional rolling is preferably applied to meet additional requirements of the final product.

B—Tilt-roll Fixture

Conventional rolling mills for rolling metal plate and/or sheet are well known in the art. In a typical rolling mill, each of the work rolls will be substantially the same diameter and operate at substantially the same rolling speed.

Figure 8:
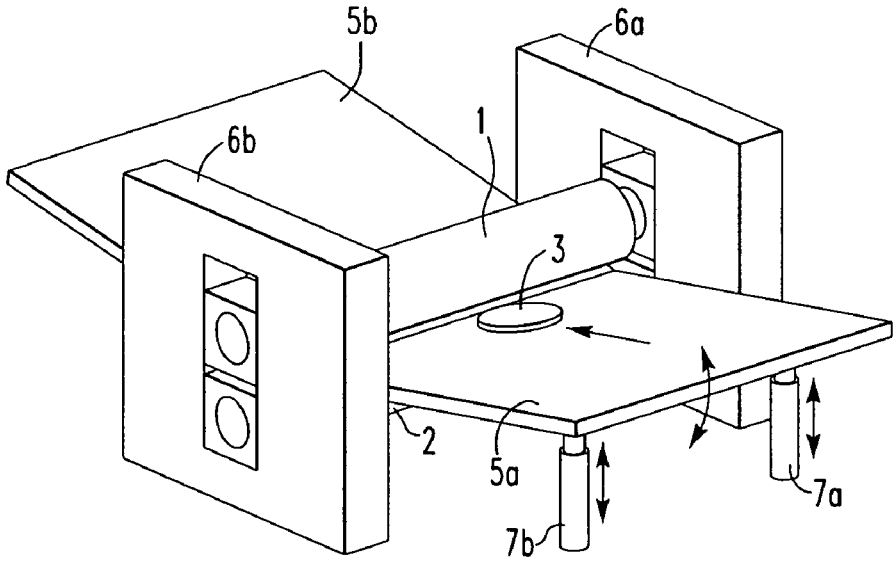
FIG. 8 is a diagram of a specially designed rolling mill with tilted aprons for tilt rolling.

A conventional rolling mill may be re-designed and manufactured to permit tilting the aprons about an axis parallel to the axis of the rolls. A schematic of such a rolling mill is depicted in FIG. 8. The top (1) and bottom (2) rolls are supported by a mill frame (6*a-b*). A workpiece (3) is fed into the rolls (1) and (2) with a tilt angle, by means of an apron (5*a-b*) that is optionally tilted at different angles. The apron (5*a-b*) can be tilted by positioning arms (7*a-b*). Tilting of the aprons may be achieved by any method, and can be designed by one skilled in the art. Preferably, the aprons are also movable in both the vertical and rolling direction to ensure perfect entry as explained below.

As an alternative to a specially designed rolling mill, tilt rolling can be achieved by means of a tilt-roll fixture, which can be installed on a conventional rolling mill without major modifications. This gives a production facility more flexibility.

Figure 9:
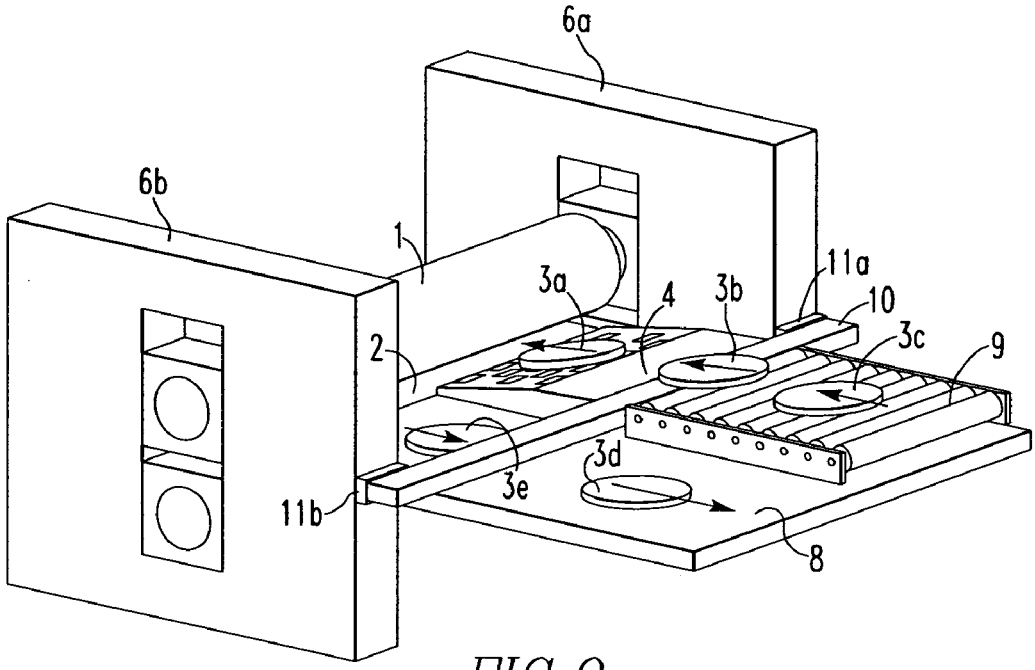
FIG. 9 is a diagram of an exemplary embodiment of a tilt rolling apparatus installed on a conventional rolling mill.

An embodiment of a tilt roll fixture that can be used in the methods of the present invention is shown in FIG. 9, which shows a rolling mill having work rolls (1) and (2), a mill frame (6*a-b*), and an apron (8). The tilt roll fixture comprises components such as an optional transfer table (9), an optional cross-bar (10) and a tilted-feed table (4). The tilted-feed table (4) can manufactured for a specific tilt angle or variable tilt angle by pivoting the table about an axis parallel to the axis of the rolls. The workpiece is fed into the work rolls (1) and (2) by maintaining the entry tilt angle. As the workpiece moves between the rolls, the workpiece tends to get pushed to horizontal and the trailing edge of the workpiece pushes down on the tilted-feed table causing a drag force on the tilted-feed table. Optionally, the tilted feed table can be provided with rollers (12) in FIG. 10. The rollers (12) in FIG. 10 on the tilted feed table decrease the drag force by reducing the friction between the workpiece and the tilted-feed table. The transfer of the workpiece into the rolls is easier in the presence of rollers on the transfer table (9).

The fixture is supported by the cross-bar (10) attached to the mill frame (6*a-b*) to prevent the fixture from being pulled into the work rolls. As an alternative to the cross-bar, the tilted-feed table may be bolted on the apron (8) if the apron is strongly supported structurally. The shims (11*a-b*) between the mill frame (6*a-b*) and cross-bar (10) permit adjustment of the tilted-feed table horizontally and the shims (13) between the apron (5) and tilted-feed table (4) in FIG. 10 enable the adjustment in vertical direction. The adjustments in the horizontal and vertical directions are necessary to ensure "Perfect entry". In the embodiment shown in FIG. 10, the tilt fixture was installed on only one side of the mill, although optionally the same fixture can be installed on both sides if needed. In order to utilize both tilt-fixtures, the first fixture can be installed on one face of the roll and the second fixture is installed on the opposite face covering only the half width of rolls.

A workpiece tends to curl in conventional rolling as well as tilt rolling process. If the workpiece curls in one pass, it becomes difficult to feed the workpiece into the rolls for the next pass. This may become a severe problem for both conventional and tilt rolling. This can be managed as shown in FIG. 9, which illustrates use of a half-width of the work roll for tilt rolling. The other half width of the work roll is available for a "free pass" as shown in FIG. 9, or for conventional rolling. This embodiment may achieve two objectives during tilt rolling: 1) flattening the workpiece, and 2) transferring the workpiece to the side where the tilt-fixture is installed for the next tilt-roll pass. During a free pass, the roll gap between the top and bottom rolls is such that there is no, or very slight, reduction in thickness. Although there is no thickness reduction of the workpiece, the workpiece is flattened during the free pass. Once the workpiece is transferred back to the side of the mill with the tilt-roll fixture, the workpiece can be located on the transfer table manually or by using a crane with a suction cup. The workpiece can then be easily pushed into the work rolls for the next pass manually or using a hydraulic pusher.

In order to achieve the benefits of tilt rolling throughout the workpiece, the tilt angle should be retained during tilt-rolling. A workpiece tends to get pushed to horizontal once the trailing edge comes off the tilted-feed table. When this happens tilt-rolling changes to conventional rolling, and the benefits of tilt-rolling cannot be obtained in the material that is being rolled.

Figure 10:
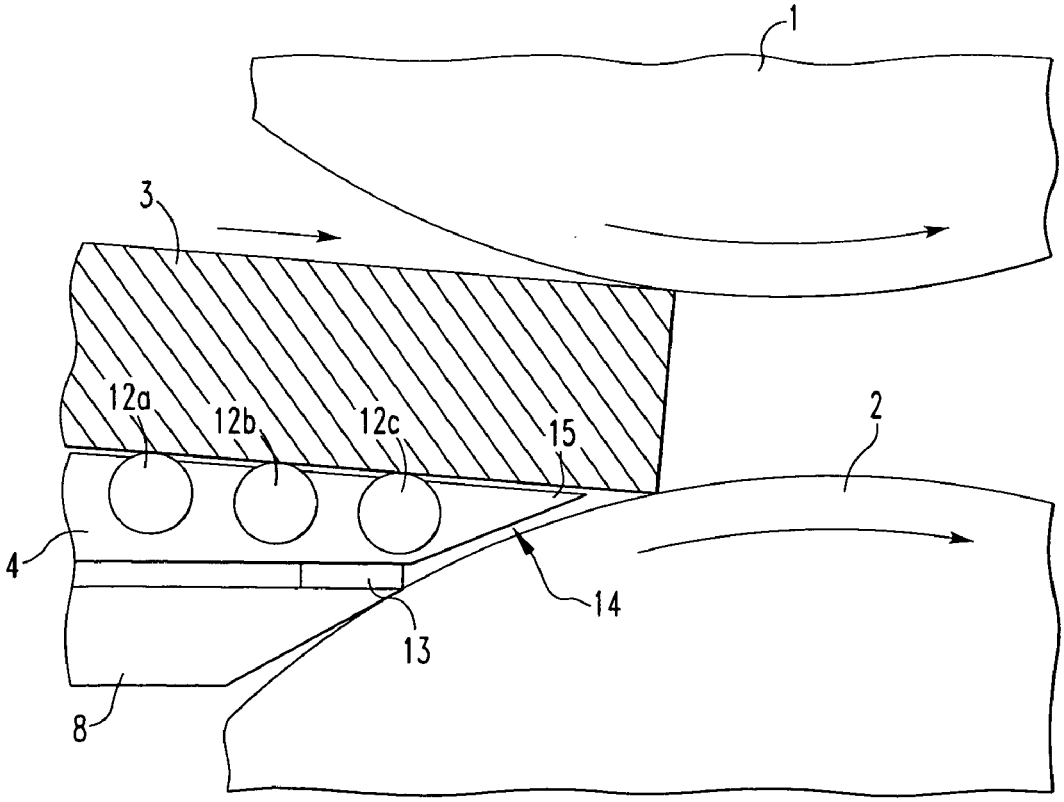
FIG. 10 is a diagram illustrating entry of a workpiece into the rolls. The "perfect entry" position is illustrated. The workpiece contacts with the top and bottom rolls simultaneously in perfect entry position.

To minimize this effect, it is important to minimize the distance between the work rolls and the tip of the tilted-feed table (15). FIG. 10 shows a close-up view of the tip of the tilted-feed table (15). The rollers (12*a-c*) on the tilted-feed table (4) have an important function of reducing the friction between the workpiece (3) and the tilted-feed table (4). The requirement for having rollers on the tilted-feed table as close as possible to the rolls (1) and (2), where the available space to support the rolls is very limited, is an important consideration for the design of the rollers and the tilted-feed table. The taper angle (14) at the tip of the tilted-feed table (15) makes it possible to approach the rolls as close as possible while providing enough space for supporting the rollers with adequate strength.

The tilt-angle also cannot be retained if a workpiece is not fed into the rolls with conditions for "perfect entry", where both top and bottom edges of the workpiece make contact with the top and bottom rolls simultaneously. When perfect entry is not established, the tilt angle of the workpiece is different than the tilt angle of the tilted-feed table.

In addition to controlling the tilt angle, perfect entry is required for maintaining a large contact area between the workpiece and the tilted-feed table. If a workpiece is not fed with conditions for perfect entry, the contact between the workpiece and the tilted-feed table is reduced from area contact to line contact, either at the tip of the table or at the trailing edge of the workpiece. Line contact may cause excessive contact pressure on the tilted-feed table or the workpiece that may cause defects in the table or the workpiece.

To achieve perfect entry, the tip of the tilted-feed table should be correctly positioned; position will vary as a function of the thickness and % reduction per pass. Once the tip of the table is positioned in the vertical direction to ensure perfect entry, the tip of the table is preferably positioned in the horizontal direction to move the tip as close to the rolls as possible. Therefore, the tilted-feed table (4) should be made adjustable to move in vertical and rolling directions. The tilted feed table (4) can be adjusted in vertical and rolling directions by changing the shim heights (13) in FIG. 10 and (11*a-b*) in FIG. 9, respectively. The flatness of the workpiece also contributes to the conditions for the perfect entry. The adjustments explained here for perfect entry can be accomplished much more accurately for a flat workpiece.

Another advantage of the fixture is that it can be easily installed within 15 minutes on a conventional rolling mill. The installation requires no major modification to the rolling mill. The rolling mill can be used for conventional rolling, and then changed over to tilt-rolling without major disruption of production.

EXAMPLES

The invention is further illustrated by the following examples, which are not meant to be limiting.

In the two examples presented below, a tantalum workpiece made by powder metallurgy was used as the starting workpiece material for rolling. The texture of a workpiece produced by powder metallurgy is known to be close to random. The effects of tilt-rolling can be clearly observed if a workpiece with random texture is used as the starting material so that the effect of the prior processing can be isolated.

Example 1 (Comparative)

Three plates, 7 to 8 mm thick were produced from powder made in accordance with U.S. Pat. No. 6,521,173. The process given below (steps 1 to 6), results in a puck 165 mm diameter and 81 mm thick.

Specifically, the operations are:

1) Cold Isostatically Press (CIP) the powder to 60-90% density;

2) Encapsulate the pressed preform in a steel can and evacuate and seal the can;

3) Hot Isostatically Press (HIP) the preform to a billet with 100% density;

4) Remove the steel can;

5) Anneal the billet; and

6) Cut, using a band-saw or any similar suitable cutting equipment, into slices suitable for rolling into a plate: the slices have the shape of a hockey puck.

The pucks were rolled using conventional techniques (including an annealing step at 33 mm thickness), and finish-processed conventionally. In rolling, 15% reduction per pass and 90-deg rotations between passes were used. The workpiece was not turned over.

Samples were taken from the centre of the plate, the mid-radius of the plate and the edge of the plate (2 samples, well separated), and the texture determined by EBSD, using a 10 μm step in both horizontal and vertical directions. The average grain size was about ASTM 7 (28 microns ALI). Once the texture maps showing the texture from top to bottom surface of the sample were obtained, the texture maps were analyzed mathematically to quantify the through-thickness texture gradient as follows:

1) The maps are divided into two halves, the top half (H1) and bottom half (H2).

2) A mask, with a cut-out hole 90 μm high, but full-width (1.64 mm), is placed over the map, such that the top of the cut-out hole corresponds to the top of the map. Note that the height of the window is chosen to be approximately 3 grains, but an integral number of EBSD steps (in this case, 9 steps).

3) The percentage of the area of the cut-out hole occupied by the grains within 15-deg of <100>//ND, as is the percentage occupied by the grains within 15-deg of <111>//ND.

4) The mask is moved down by 10 μm, and the calculations repeated.

5) Operation 4 is repeated until the bottom of the cut-out hole corresponds to the bottom of the map.

6) This data is analyzed to determine, for each half of the thickness:

a) The gradient of the best-fit straight line through the 100 data, expressed as % per mm (100 Grad).

b) The gradient of the best-fit straight line through the 111 data, expressed as % per mm (111 Grad).

The results of this analysis, for both half-thicknesses of the three specimens, are:

TABLE 2

| | 100 Grad | 111 Grad |
|---|---|---|
| Plate 1 | | |
| Centre H1 | −4.09 | 1.71 |
| Centre H2 | 1.93 | −3.10 |
| Mid-Rad H1 | −5.95 | 4.0 |
| Mid-Rad H2 | 4.28 | −3.89 |
| Edge 1 H1 | −3.28 | 6.32 |
| Edge 1 H2 | 5.19 | −2.48 |
| Edge 2 H1 | −5.64 | 4.70 |
| Edge 2 H2 | 7.94 | −4.47 |
| Plate 2 | | |
| Centre H1 | −6.34 | 4.96 |
| Centre H2 | 4.55 | −6.92 |
| Mid-Rad H1 | −6.48 | 7.97 |
| Mid-Rad H2 | 5.54 | −9.04 |
| Edge 1 H1 | −6.50 | 8.00 |
| Edge 1 H2 | 6.36 | −7.48 |
| Edge 2 H1 | −7.57 | 8.48 |
| Edge 2 H2 | −7.61 | 8.79 |
| Plate 3 | | |
| Centre H1 | −5.20 | 4.97 |
| Centre H2 | 4.38 | −2.14 |
| Mid-Rad H1 | −8.36 | 5.76 |
| Mid-Rad H2 | 5.96 | −6.74 |
| Edge 1 H1 | −4.93 | 5.60 |
| Edge 1 H2 | 4.89 | −4.46 |
| Edge 2 H1 | −5.07 | 3.91 |
| Edge 2 H2 | 7.80 | −7.46 |

Example 2 (Inventive)

A plate 7.5 mm thick was made, using the same powder-metallurgy process as was described above, (steps 1 to 6), resulting in a puck 165 mm diameter and 42 mm thick.

It was then rolled to thickness. A 5-degree tilt angle was used. The thickness of the piece was reduced by approximately 5-10% in each pass. The piece was rotated 45 degrees about a vertical axis after each pass. The piece was turned over after every 4 passes. The final thickness of the piece after rolling was 7.5 mm. The finish-processing (annealing etc.) was performed conventionally.

Samples were taken from the centre of the plate, the mid-radius of the plate and the edge of the plate, and the texture determined by EBSD, using a 15 μm step in both horizontal and vertical directions. The average grain size was about ASTM 6½ (32 microns ALI). The results are calculated in the same way as for Example 1.

TABLE 3

| | 100 Grad | 111 Grad |
|---|---|---|
| Centre H1 | −1.78 | 2.10 |
| Centre H2 | 1.60 | 1.85 |
| Mid-Rad H1 | −1.11 | 1.20 |
| Mid-Rad H2 | 2.84 | 2.70 |
| Edge H1 | −1.06 | 0.97 |
| Edge H2 | 0.54 | 0.50 |

Although the number of data points is limited, a statistical comparison of the prior art and the inventive method may be useful. In Table 4, the variation of the texture gradient for example 1 (comparative) and example 2 (inventive) are compared. The absolute value of the texture gradient values listed in Table 2 and 3, were used to obtain the min-max range, mean and standard deviation of texture gradient for plates 1, 2, 3 in Example 1, and the plate in Example 2. Table 4 shows that the method described in this invention reduced the texture gradient for both 100 and 111 components significantly.

TABLE 4

| | Min-Max 100 Grad | Mean 100 Grad | Standard Deviation 100 Grad | Min-Max 111 Grad | Mean 111 Grad | Standard Deviation 111 Grad |
|---|---|---|---|---|---|---|
| Example 1 (Plate 1) | 1.93-7.94 | 4.79 | 1.83 | 1.71-6.32 | 3.83 | 1.43 |
| Example 1 (Plate 2) | 4.55-7.61 | 6.37 | 1.00 | 4.96-9.04 | 7.71 | 1.30 |
| Example 1 (Plate 3) | 4.38-8.36 | 5.82 | 1.47 | 2.14-7.46 | 5.13 | 1.67 |
| Example 2 | 0.54-2.84 | 1.49 | 0.79 | 0.50-2.70 | 1.55 | 0.81 |

Whereas particular embodiments of this invention have been described above for purposes of illustration, it will be evident to those skilled in the art that numerous variations of the details of the present invention may be made without departing from the invention as defined in the appended claims.

What is claimed is:

1. A method comprising:

feeding a workpiece into rolls in a rolling mill, wherein the workpiece is tilted about an axis parallel to the axis of the rolls of a rolling mill to a tilt angle between 2-20 degrees, wherein the workpiece is a metal plate or sheet;

so that the texture of the workpiece is controlled, wherein the method includes more than one pass through rolls at a tilt angle of between 2-20 degrees at a predetermined reduction schedule calculated to adjust the shear strain distribution through the thickness of the material and which the workpiece is a) turned over between passes at regular intervals; or b) passed successively through two or more rolling mills and the direction of the tilt angle is alternated between the successive rolling mills; and wherein the workpiece after feeding has a shear texture that is increased and the workpiece after feeding has a percentage of grains in a unit volume of a fcc metal aligned within 15-deg of <100>//ND and <111>//ND that is larger than 10.2% and 13.6%, respectively.

2. The method of claim 1, wherein the tilt angle is between 10 and 20 degrees and the reduction schedule is optimized to maximize the amount of shear strain in the material, whereby the shear texture is achieved.

3. The method of claim 1, wherein the process includes a step of installing a tilted feed table to the rolling mill for feeding the workpiece into the rolls of the mill.

4. The method of claim 3, wherein the number of passes is 4 or more and wherein the workpiece is turned over between two passes.

5. The method of claim 3, wherein a predetermined % reduction in thickness per pass is used to achieve substantially no curling; wherein the maximum strain due to curling is less than 10% of normal strain induced in the rolling pass.

6. A method comprising:

feeding a workpiece into rolls in a rolling mill, wherein the workpiece is tilted about an axis parallel to the axis of the rolls of a rolling mill to a tilt angle between 2-20 degrees, wherein the workpiece is a metal plate or sheet;

so that the texture of the workpiece is controlled, wherein the method includes more than one pass through rolls at a tilt angle of between 2-20 degrees at a predetermined reduction schedule calculated to adjust the shear strain distribution through the thickness of the material and which the workpiece is a) turned over between passes at regular intervals; or b) passed successively through two or more rolling mills and the direction of the tilt angle is alternated between the successive rolling mills; and wherein the workpiece after feeding has a shear texture that is increased and the workpiece after feeding has a percentage of grains in a unit volume of a bcc metal aligned within 15-deg of <110>//ND is larger than 20.4%.

7. The method of claim 6, wherein the process includes a step of installing a tilted feed table to the rolling mill for feeding the workpiece into the rolls of the mill.

8. The method of claim 7, wherein the number of passes is 4 or more and wherein the workpiece is turned over between two passes.

9. The method of claim 7, wherein a predetermined % reduction in thickness per pass is used to achieve substantially no curling; wherein the maximum strain due to curling is less than 10% of normal strain induced in the rolling pass.

10. A method comprising:

feeding a workpiece into rolls in a rolling mill, wherein the workpiece is tilted about an axis parallel to the axis of the rolls of a rolling mill to a tilt angle between 2-20 degrees, wherein the workpiece is a metal plate or sheet;

so that the texture of the workpiece is controlled, wherein the method includes more than one pass through rolls at a tilt angle of between 2-20 degrees at a predetermined reduction schedule calculated to adjust the shear strain distribution through the thickness of the material and which the workpiece is a) turned over between passes at regular intervals; or b) passed successively through two or more rolling mills and the direction of the tilt angle is alternated between the successive rolling mills; and wherein the through-thickness texture gradient for each of the texture components 100//ND and 111//ND is less than or equal to 4% per mm.

11. The method of claim 10, wherein the workpiece is produced by powder metallurgy so that the metal plate or sheet has close to a random texture.

12. The method of claim 10, wherein the tilt angle is between 3 and 7 degrees, and the reduction schedule is adjusted to achieve substantially uniform shear strain through the thickness of the material, wherein through-thickness texture gradient is minimized.

13. The method of claim 10 wherein the number of passes is 4 or more.

14. The method of claim 10, wherein the workpiece is turned over between passes.

15. The method of claim 10, wherein a predetermined % reduction in thickness per pass is used to achieve substantially no curling; wherein the maximum strain due to curling is less than 10% of normal strain induced in the rolling pass.

16. The method of claim 15, wherein the % reduction per pass is up to 20%.

17. The method of claim 16, wherein the workpiece has a thickness from 0.250 to 2.000 inches.

18. The method of claim 17, wherein the tilt angle is about 5°.

19. The method of claim 18, wherein the workpiece has a top edge and a bottom edge, wherein the top and bottom edges of the workpiece contact the rolls of the mill simultaneously.

20. The method of claim 15, wherein the tilt angle is about 5°.

21. The method of claim 20, wherein the workpiece has a top edge and a bottom edge, wherein the top and bottom edges of the workpiece contact the rolls of the mill simultaneously.

22. The method of claim 10, wherein the workpiece includes tantalum.

23. The method of claim 10, wherein the workpiece is a silicon steel and the method improves the magnetic permeability of the workpiece.

24. The method of claim 10, wherein the rolling mills includes work rolls that operate at substantially the same rolling speed.

25. The method of claim 10, wherein the process includes a step of flattening the workpiece, and the step of flattening the workpiece results in no thickness reduction of the workpiece.

26. The method of claim 10, wherein the process includes a step of installing a tilted feed table to the rolling mill for feeding the workpiece into the rolls of the mill.

27. The method of claim 26, wherein the tilted feed table includes rollers incorporated into the table and a forward end that is tapered at the tip for supporting the rollers of the feed table and for allowing the tilted feed table to closely approach the rolls of the rolling mill; and wherein the process includes rolling the workpiece on the rollers of the tilted feed table.

28. The method of claim 26, wherein area contact between the workpiece and the tilted feed table is maintained.

29. The method of claim 26, wherein the workpiece has a top edge and a bottom edge, wherein the top and bottom edges of the workpiece contact the rolls of the mill simultaneously.

30. The method of claim 10, wherein the process includes a step of increasing the temperature of the workpiece above the recrystallization temperature to achieve recrystallization.

31. The method of claim 10, wherein the method includes the steps of:

providing a rolling mill;

rolling on the rolling mill in the absence of any tilt angle; and attaching a tilt table to the rolling mill to provide a tilt angle for rolling.

32. The method of claim 10, wherein the method includes a step of:

maintaining the uniformity of the friction coefficient of the workpiece with the rolls of the mill.

33. The method of claim 10, wherein the tilt angle is about 5°, the workpiece has a thickness from about 0.25 to about 2 inches, and the % reduction per pass is 5-20°.

34. The method of claim 10, wherein the texture is determined by EBSD using a 15 μm step in both horizontal and vertical directions.

35. The method of claim 10, wherein the process employs a conventional rolling mill that has been modified to allow for tilt-rolling.

* * * * *